US009885328B2

(12) United States Patent
Matsukawa et al.

(10) Patent No.: US 9,885,328 B2
(45) Date of Patent: Feb. 6, 2018

(54) FUEL INJECTION VALVE

(71) Applicant: DENSO CORPORATION, Kariya, Aichi-pref. (JP)

(72) Inventors: Tomoji Matsukawa, Obu (JP); Hiroyuki Inoue, Gifu (JP)

(73) Assignee: DENSO CORPORATION, Kariya (JP)

( * ) Notice: Subject to any disclaimer, the term of this patent is extended or adjusted under 35 U.S.C. 154(b) by 96 days.

(21) Appl. No.: 14/856,812

(22) Filed: Sep. 17, 2015

(65) Prior Publication Data

US 2016/0076499 A1 Mar. 17, 2016

(30) Foreign Application Priority Data

Sep. 17, 2014 (JP) ..... 2014-188855

(51) Int. Cl.
*F02M 51/06* (2006.01)

(52) U.S. Cl.
CPC ..... *F02M 51/0685* (2013.01); *F02M 51/061* (2013.01); *F02M 51/0625* (2013.01); *F02M 2200/50* (2013.01)

(58) Field of Classification Search
CPC ..... F02M 51/0685; F02M 51/061; F02M 51/0614; F02M 51/0628; F02M 51/0625; F02M 51/0635; F02M 51/0639
See application file for complete search history.

(56) References Cited

U.S. PATENT DOCUMENTS

2003/0047626 A1* 3/2003 Maier ..... F02M 51/0671 239/585.5
2007/0240696 A1* 10/2007 Jackson ..... F01L 1/28 123/79 C
2008/0223960 A1* 9/2008 Yamamoto ..... F02M 51/0603 239/533.8
2011/0057059 A1* 3/2011 Yamamoto ..... F02M 51/0675 239/584

FOREIGN PATENT DOCUMENTS

| | | |
|---|---|---|
| JP | 2006-097659 | 4/2006 |
| JP | 2010-180758 | 8/2010 |
| JP | 2011-137442 | 7/2011 |
| JP | 2012-172594 | 9/2012 |
| JP | 2013-104340 | 5/2013 |

* cited by examiner

*Primary Examiner* — Arthur O Hall
*Assistant Examiner* — Tuongminh Pham
(74) *Attorney, Agent, or Firm* — Nixon & Vanderhye P.C.

(57) ABSTRACT

A bush is disposed on an inner wall of a fixed core. A second spring, which biases a movable core in a valve-closing direction, has one end abutting the bush. The bush is formed separately from the fixed core, and is formed to be movable relative to the fixed core when adjusting a biasing force of the second spring. When a needle is abutting a valve seat, a gap is formed between a movable core first abutting face of the movable core and a flange end face of a flange portion included in the needle. Accordingly, during valve-opening, a relatively large force in a valve-opening direction is applied to the needle. Further, by changing the position of the bush relative to the movable core, the biasing force of the (Continued)

second spring may be adjusted without changing a length of the gap in a central axis direction.

9 Claims, 6 Drawing Sheets

FUEL INJECTION VALVE

CROSS REFERENCE TO RELATED APPLICATION

The present application is based on Japanese Patent Application No. 2014-188855 filed on Sep. 17, 2014, disclosure of which is incorporated herein by reference.

TECHNICAL FIELD

The present disclosure relates to a fuel injection value that supplies fuel to an internal combustion engine (hereinafter, "engine").

BACKGROUND

One conventionally known fuel injection valve, which has a housing, injects fuel from the housing to an external target. The fuel is injected by a needle reciprocating to open and close an injection hole of the housing. For example, a fuel injection valve described in JP 2013-104340A includes a movable core, a flange portion, and a biasing member. A coil generates a magnetic field to attract the movable core to a fixed core. The flange portion is provided on a needle such that, when the valve is closed, a gap having a predetermined distance in a central axial direction of a housing is formed between the movable core and the flange portion. Further, the biasing member biases the movable core and the flange portion such that this gap is formed between the movable core and the flange portion.

SUMMARY

In the fuel injection valve of JP 2013-104340A, when the coil generates the magnetic field and the movable core is attracted to the fixed core, the movable core uses the gap between the movable core and the flange portion to accelerate and move in a valve-opening direction, and thereafter abuts the flange portion. As a result, when the fuel injection valve described in JP 2013-104340A opens, a relatively large force in the valve-opening direction is applied through the flange portion to the needle. For this reason, even if the fuel pressure in the housing is relatively high, the needle can be moved in the valve-opening direction.

Incidentally, in the fuel injection valve described in JP 2013-104340A, the biasing member is provided between the movable core and the flange portion. Thus, the biasing force of the biasing member is determined by the positional relationship between the movable core and the flange portion. Meanwhile, the length of the gap between the movable core and the flange portion is also determined by the positional relationship between the movable core and the flange portion. For this reason, the length of the gap between the movable core and the flange portion, and the amount of the biasing force of the biasing member, may not be individually adjusted. As a result, when the fuel injection valve is opening, the valve-opening direction force applied to the needle may differ for each individual fuel injection valve, and there is a concern that fuel injection amounts may vary.

An object of the present disclosure is to provide fuel injection valves that increase a valve-opening force for a needle member, and that may suppress variations in fuel injection amounts across each individual fuel injection valve.

In the present disclosure, a fuel injection valve includes a housing, a needle member, a flange portion, a movable core, a restricting portion, a fixed core, a bush, a coil, a first biasing member, and a second biasing member.

The needle member is reciprocably disposed within the housing, the injection hole being open when one end of the needle member separates from a valve seat of the housing and being closed when the one end of the needle member abuts the valve seat.

The flange portion is disposed on a radially outward side of an other end of the needle member and is integrally reciprocable with the needle member.

The restricting portion is disposed on one side of the movable core toward the valve seat, the movable core being disposed on one side of the flange portion toward the valve seat, and the movable core being movable relative to the needle member. The restricting portion is configured to restrict movement of the movable core in a valve-closing direction when the movable core abuts the restricting portion.

The bush is formed separately from the fixed core, which is fixed to the housing. The bush is disposed at an inner wall or an outer wall of the fixed core.

One end of the first biasing member abuts the flange portion or the needle member, and biases the needle member in a valve-closing direction.

One end of the second biasing member abuts an end face of the bush facing the valve seat, and an other end of the second biasing member abuts the movable core. The second biasing member biases the movable core in the valve-closing direction.

In the fuel injection valve of the present disclosure, when the movable core abuts the restricting portion, a gap is formed between the flange portion and the movable core.

In the fuel injection valve of the present disclosure, when the fuel injection valve is opening and the coil is energized, the coil generates a magnetic field around the coil. As a result, the movable core uses the gap between the end face of the flange portion facing the movable core and the end face of the movable core facing the flange portion to accelerate and move in the valve-opening direction, and abut the flange portion. Accordingly, in the fuel injection valve of the present disclosure, when the fuel injection valve is opening, a relatively large force in the valve-opening direction may be applied to the needle member. For this reason, even if the fuel pressure within the housing is relatively high, the needle member maybe moved in the valve-opening direction.

In the fuel injection valve of the present disclosure, when the fuel injection valve is opening, the movable core uses the gap between the flange portion and the movable core to accelerate and abut the flange portion. In a fuel injection valve such as this, the movement speed of the movable core at the moment of abutting the flange portion is determined based on the length of the gap in the central axis direction, as well as based on a relationship between the magnitude of the magnetic attracting force generated between the movable core and the fixed core, the magnitude of the biasing force that biases the needle member in the valve-closing direction, and the magnitude of the biasing force that biases the movable core in the valve-closing direction. The movement speed of the movable core at the moment of abutting the flange portion is, in other words, the movement speed of the needle member. Here, the movement speed of the needle member is correlated with fuel injection characteristics such as the amount of fuel injected during one operation of this fuel injection valve, and the amount of fuel injected per time unit.

In the fuel injection valve of the present disclosure, the second biasing member, which biases the movable core in the valve-closing direction, has one end that abuts the end face of the bush facing the valve seat. The bush is formed separately from the fixed core and the position of the bush with respect to the fixed core may be changed. Accordingly, the biasing force of the second biasing member may be adjusted without changing the length of the gap between the flange portion and the movable core. As a result, the movement speed of the movable core may be adjusted by only adjusting the biasing force of the second biasing member, and thus the injection characteristics of this fuel injection valve may be adjusted. Accordingly, variations in fuel injection amounts across each individual fuel injection valve may be minimized.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Hereinafter, a plurality of embodiments of the present disclosure will be explained with reference to the figures.

First Embodiment

Figure 1:
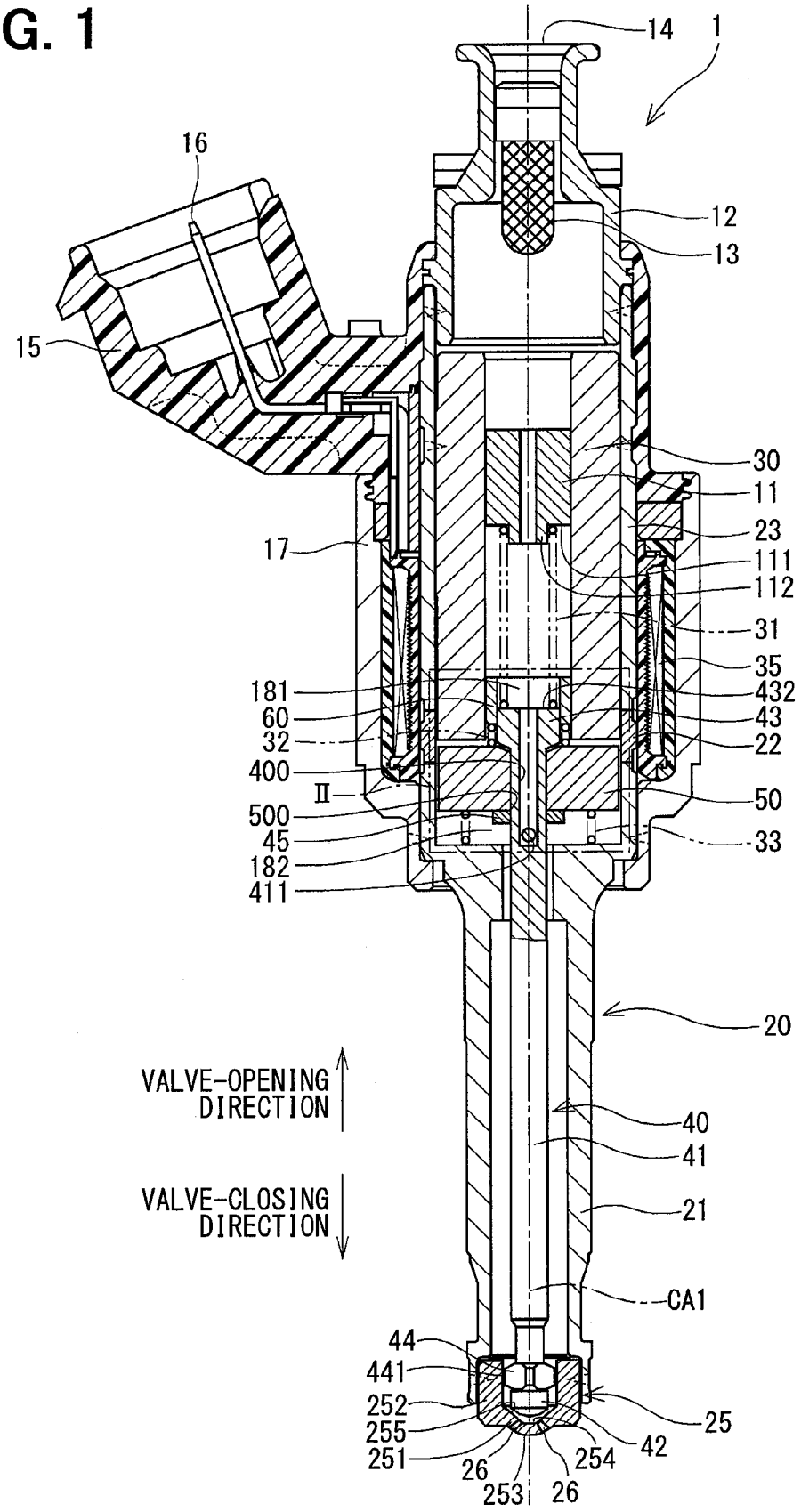
FIG. 1 is a cross-sectional view showing a fuel injection valve according to a first embodiment of the present disclosure.
Figure 2:
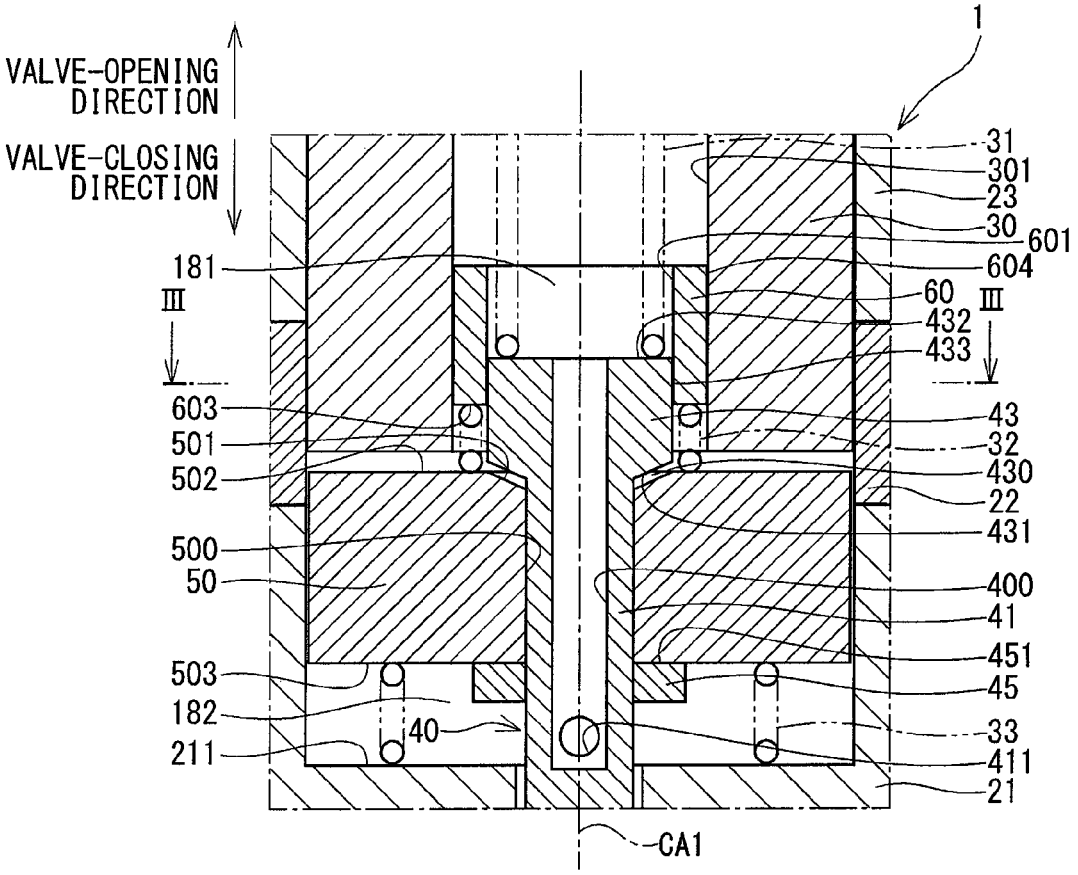
FIG. 2 is an enlarged view showing region II of FIG. 1.
Figure 3:
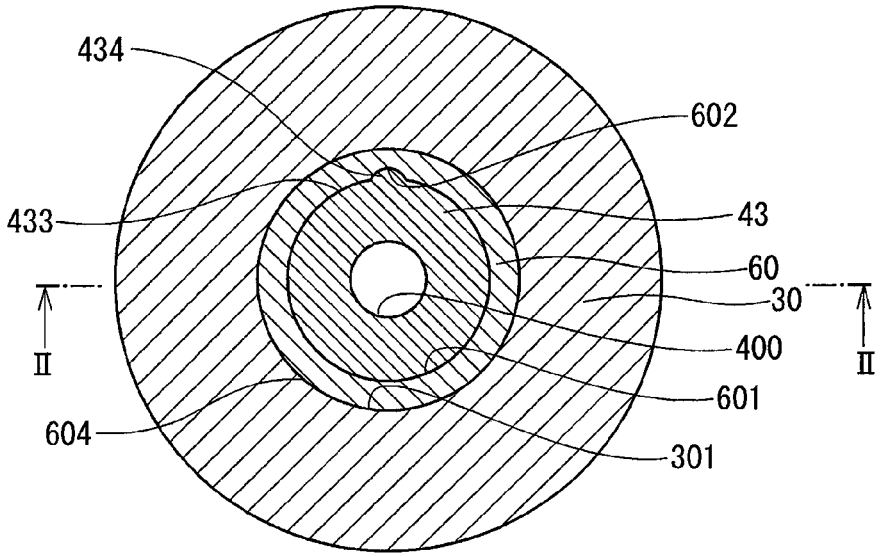
FIG. 3 is a cross-sectional view along the III-III line of FIG. 2.

A fuel injection valve 1 in accordance with a first embodiment of the present disclosure is shown in FIGS. 1 to 3. Further, in FIGS. 1 and 2, a valve-opening direction is shown as the direction in which a needle 40 separates from a valve seat 255. In addition, a valve-closing direction is shown as the direction in which the needle 40 abuts the valve seat 255.

The fuel injection valve 1 is used in a fuel injection device of, e.g., a direct injection type gasoline engine (not illustrated). In this case, the fuel injection valve 1 supplies fuel by injecting high pressure gasoline to the engine. The fuel injection valve 1 includes a housing 20, the needle 40, a movable core 50, a restricting member 45 that acts as a "restricting portion", a fixed core 30, a bush 60, a coil 35, a first spring 31 that acts as "a first biasing member", a second spring 32 that acts as "a second biasing member", and a third spring 33 that acts as "a third biasing member".

As shown in FIG. 1, the housing 20 is formed from a first cylinder member 21, a second cylinder member 22, a third cylinder member 23, and an injection nozzle 25. Each of the first cylinder member 21, the second cylinder member 22, and the third cylinder member 23 are cylindrical shaped. Further, the first cylinder member 21, the second cylinder member 22, the third cylinder member 23 are arranged coaxially, and are connected to one another in this order.

The first cylinder member 21 and the third cylinder member 23 are formed from magnetic materials, such as ferritic stainless steel having undergone magnetic stabilization treatment. The hardness of the first cylinder member 21 and the third cylinder member 23 is relatively low. Conversely, the second cylinder member 22 is formed from non-magnetic materials, such as austenitic stainless steel. The hardness of the second cylinder member 22 is higher than the hardness of the first cylinder member 21 and the third cylinder member 23.

The injection nozzle 25 is disposed on an end of the first cylinder member 21 opposite from the second cylinder member 22. The injection nozzle 25 has a cylindrical shape with one closed end and is formed from metals such as martensitic stainless steel. The injection nozzle 25 is welded to the first cylinder member 21. Further, hardening treatment is performed on the injection nozzle 25 such that the injection nozzle 25 has a fixed hardness. The injection nozzle 25 is formed from an injection portion 251 and a cylinder portion 252.

The injection portion 251 is symmetrical about a central axis CA1 of the housing 20. The central axis CA1 is coaxial with the central axis of the fuel injection valve 1. A plurality of injection holes 26, through which the interior of the housing 20 is in communication with the exterior of the housing 20, are formed in the injection portion 251. Specifically, the injection holes 26 include apertures formed in an inner wall 254 of the injection portion 251. Here, a valve seat 255 is formed surrounding the apertures of the injection holes 26.

The cylinder portion 252 surrounds the injection portion 251, and is radially outward from the injection portion 251. Further, the cylinder portion 252 extends in a direction opposite from a direction in which an outer wall 253 of the injection portion 251 projects out.

The needle 40 is formed from metals such as martensitic stainless steel. Further, hardening treatment is performed on the needle 40 such that the needle 40 has the same level of hardness as the injection nozzle 25.

The needle 40 is reciprocably housed within the housing 20. The needle 40 is formed from a shaft portion 41, a seal portion 42 that acts as "one end of the needle member", and a flange portion 43. The shaft portion 41, the seal portion 42, and the flange portion 43 are integrally formed. The shaft portion 41 and the seal portion 42 together correspond to "a needle member".

The shaft portion 41 is rod-shaped. An end of the shaft portion 41 toward the fixed core 30 is cylindrical shaped. A flow path 400, in which fuel flows, is formed in the end of the shaft portion 41 toward the fixed core 30. One end of the flow path 400 toward the valve seat 255 is in communication with an opening 411 in the shaft portion 41. Accordingly, the flow path 400 and the opening 411 are in communication with a fuel path 181 and a fuel path 182. The fuel path 181 acts as "a fuel path at one side of the movable core away from the valve seat" and is at one side of the flange portion 43 toward the valve seat 255. The fuel path 182 is at the one side of the movable core 50 toward the valve seat 255. The flow path 400 and the opening 411 together correspond to "a needle passage".

The seal portion 42 is disposed in an end of the shaft portion 41 toward the valve seat 255 so as to be abuttable with the valve seat 255. The seal portion 42 separates from the valve seat 255 or abuts the valve eat 255 to open and close the injection holes 26. As a result, the needle 40 opens and closes communication between the interior of the housing 20 and the exterior of the housing 20.

A slide contact portion 44 is formed between the shaft portion 41 and the seal portion 42. The slide contact portion 44 is cylindrical shaped and a portion of an outer wall 441 thereof is chamfered. The non-chamfered portions of the outer wall 441 of the slide contact portion 44 is in slidable contact with an inner wall of the injection nozzle 25. From this, reciprocation of a tip portion of the needle 40 toward the valve seat 255 is guided.

The flange portion 43 is substantially annular shaped, and is disposed on a radially outward side of the end of the shaft portion 41 near the fixed core 30. The flange portion 43 includes a flange end face 431 facing toward the valve seat 255. The flange end face 431 is formed so as to be angled with respect to the central axis CA1. Specifically, as shown in FIG. 2, the flange end face 431 is formed as a tapered surface that, the further from the central axis CA1, the more the flange end face 431 tapers away from the valve seat 255.

An outer wall 433 of the flange portion 43 that faces radially outward is formed to be slidable on an inner wall 601 of a bush 60 to be described later. As shown in FIG. 3, the outer wall 433 includes a protrusion 434 that is formed so as to protrude in the radially outward direction. The protrusion 434 is inserted in a groove 602 formed in the bush 60 to be described later.

The movable core 50 is cylindrical shaped and is formed from a magnetic material such as ferritic stainless steel. The movable core 50 is disposed on one side of the flange portion 43 toward the valve seat 255, and is slidable relative to the shaft portion 41.

The movable core 50 includes a movable core throughhole 500 through which the shaft portion 41 is inserted. A movable core first abutting face 501 is formed surrounding one opening of the movable core throughhole 500 toward the fixed core 30. The movable core first abutting face 501 is an end face that faces the flange end face 431. A highly wear-resistant film, such as hard chrome plating, is applied to the movable core first abutting face 501. Further, the movable core first abutting face 501 is angled, with respect to the central axis CA1, by the same angle of inclination as the flange end face 431. Specifically, as shown in FIG. 2, the movable core first abutting face 501 is formed as a tapered surface that, the further from the central axis CA1, the more the movable core first abutting face 501 tapers away from the valve seat 255.

A movable core second abutting face 502 is formed radially outward of the movable core first abutting face 501. The movable core second abutting face 502 is an end face that is abuttable with an end face of the fixed core 30 facing toward the valve seat 255. A highly wear-resistant film is applied to the movable core second abutting face 502 in the same manner as the movable core first abutting face 501.

The restricting member 45 is formed separately from the shaft portion 41. Further, the restricting member 45 is disposed on one side of the movable core 50 toward the valve seat 255, and is not movable relative to the shaft portion 41. Specifically, the restricting member 45 is substantially annular shaped, and is fixed to a radially outward side of the shaft portion 41. When the movable core 50 moves in the valve-closing direction with respect to the shaft portion 41, an end face 451 of the restricting member 45 facing the fixed core 30 abuts with an end face 503 of the movable core 50 facing the valve seat 255. As a result, movement of the movable core 50 in the valve-closing direction is restricted.

The fixed core 30 is welded to the third cylinder portion 23 of the housing 20, and is disposed so as to be fixed to the inside of the housing 20. The fixed core 30 is cylindrical shaped, and is formed from a magnetic material such as ferritic stainless steel. Magnetic stabilization treatment is performed on the fixed core 30.

The bush 60 is cylindrical shaped, and is disposed on an inner wall 301 of the fixed core 30 toward the valve seat 255. The bush 60 is formed separately from the fixed core 30, and is fixed to the inside of the fixed core 30 by, e.g., press-fitting. For adjusting the biasing force of the second spring 32, an outer wall 604 of the bush 60 is configured to be movable relative to the inner wall 301 of the fixed core 30 when adjusting the biasing force of the second spring 32. In other words, when the biasing force of the second spring 32 is not being adjusted, then the bush 60 is not movable relative to the fixed core 30. The bush 60 includes an end face 603 that faces toward the valve seat 255. The end face 603 abuts one end of the second spring 32.

The groove 602, which is formed in the inner wall 601 of the bush 60, is formed to extend in a reciprocating direction of the needle 40. The protrusion 434 of the flange portion 43 is inserted in the groove 602. As a result, the bush 60 and needle 40 are movable relative to each other in the central axis CA1 direction, but are not rotatable relative to each other.

The coil 35 is cylindrical shaped, and is disposed radially outward of the second cylinder member 22 and the third cylinder member 23, thereby surrounding the second cylinder member 22 and the third cylinder member 23. When electric power is supplied to the coil 35, the coil 35 generates a magnetic field in its surroundings. When the magnetic field is generated, a magnetic circuit is formed in the fixed core 30, the movable core 50, the first cylinder member 21, the third cylinder member 23, and a holder 17 to be described later.

An adjusting pipe 11, which is press-fitted inside the fixed core 30, includes an end face 111 that faces the valve seat 255. One end of the first spring 31 is disposed so as to abut the end face 111. A protruding portion 112 protrudes from the end face 111 of toward the valve seat 255. The protruding portion 112 is inserted into one end of the first spring 31 to move together with the one end of the first spring 31. The other end of the first spring 31 abuts an end face 432 of the flange portion 43 that faces away from the valve seat 255. The first spring 31 biases the needle 40 in the valve-closing direction such that the seal portion 42 of the needle 40 abuts the valve seat 255. The biasing force of the first spring 31 may be adjusted by changing the position of the adjusting pipe 11 with respect to the fixed core 30 and the flange portion 43.

One end of the second spring 32 is disposed so as to abut the end face 603. The other end of the second spring 32 abuts the movable core second abutting face 502. The second spring 32 biases the movable core 50 in the valve-closing direction. The biasing force of the second spring 32 may be adjusted by changing the position of the bush 60 with respect to the fixed core 30 and the movable core 50.

One end of the third spring 33 is disposed so as to abut the end face 503. The other end of the third spring 33 abuts an inner wall 211 of the first cylinder member 21. The third spring 33 biases the movable core 50 in the valve-opening direction.

In the present embodiment, the biasing force of the second spring 32 is set to be larger than the biasing force of the third spring 33. Accordingly, when no magnetic attraction force is generated between the fixed core 30 and the movable core 50, the seal portion 42 abuts the valve seat 255, and the end face 451 of the of the restricting member 45 abuts the end face 503 of the movable core 50.

As shown in FIG. 2, in the fuel injection valve 1, when the restricting member 45 abuts the movable core 50, a gap 430 is formed between the flange end face 431 and the movable core first abutting face 501.

A cylindrical fuel inlet pipe 12 is press fit and welded to one end of the third cylinder member 23 opposite from the second cylinder member 22. A filter 13 is provided within the fuel inlet pipe 12. The filter 13 collects foreign matter included in fuel flowing in from an inlet 14 of the fuel inlet pipe 12.

The exteriors of the fuel inlet pipe 12 and the third cylinder member 23 in the radial direction are molded together by resin. A connector 15 is formed in this molded portion. A terminal 16, which supplies electrical power to the coil 35, is inserted at the connector 15. Further, a cylindrical holder 17 is provided radially outward of the coil 35 to cover the coil 35.

The fuel flowing in from the inlet 14 of the fuel inlet pipe 12 flows through within the fixed core 30, within the adjusting pipe 11, within the bush 60, the flow path 400, the opening 411, between the first cylinder member 21 and the shaft portion 41, and is guided into the injection nozzle 25. In other words, a fuel path is defined from the inlet 14 to between the first cylinder member 21 and the shaft portion 41 to guide fuel into the injection nozzle 25.

Next, the operation of the fuel injection valve 1 will be explained.

When electric power is not supplied to the coil 35, the seal portion 42 of the needle 40 abuts the valve seat 255. At that time, as shown in FIG. 2, the positional relationship between the needle 40 and the movable core 50 is such that the gap 430 is formed between the movable core first abutting face 501 and the flange end face 431.

When electric power is supplied to the coil 35 and a magnetic attraction force is generated between the fixed core 30 and the movable core 50, the movable core 50 overcomes a difference between the biasing force of the second spring 32 and the biasing force of the third spring 33. As a result, the movable core 50 accelerates over a distance corresponding to the length of the gap 430 in the central axis CA1 direction, and moves in the valve-opening direction. Then, the movable core first abutting face 501 abuts the flange end face 431. At that time, a relatively large force is applied to the flange portion 43 in the valve-opening direction.

Further, due to inertial forces and the magnetic attraction force, the movable core 50 continues to move in the valve-opening direction while the movable core first abutting face 501 abuts the flange end face 431. As a result, the seal portion 42 separates from the valve seat 255, and the injection holes 26 open. When the injection holes 26 open, the fuel guided within the injection nozzle 25 is sprayed out through the injection holes 26. When the movable core 50, which is moving in the valve-opening direction, abuts the fixed core 30, the movable core 50 then stops moving in the valve-opening direction.

When electric power is cut off from the coil 35, the magnetic attraction force being generated between the fixed core 30 and the movable core 50 disappears. At that time, the biasing force of the first spring 31 is being applied to the needle 40. The difference between the biasing force of the second spring 32 and the biasing force of the third spring 33 is being applied to the movable core 50. As a result, the needle 40 and the movable core 50 move in the valve-closing direction.

When the needle 40 moves in the valve-closing direction, the injection holes 26 close, and injection of the fuel is terminated. After the seal portion 42 abuts the valve seat 255, the movable core 50 continues moving in the valve-closing direction due to inertial forces until abutting the restricting member 45 and stopping.

The fuel injection valve 1 of the first embodiment exhibits at least one of the following effects (a) to (g), but is not limited to these effects. Other effects will become apparent to those skilled in the art when viewing the present disclosure as a whole.

(a) In the fuel injection valve 1 of the first embodiment, when the end face 451 of the restricting member 45 abuts the end face 503 of the movable core 50, the gap 430 is formed between the flange end face 431 and the movable core first abutting face 501. In the fuel injection valve 1, due to the magnetic attracting force generated between the fixed core 30 and the movable core 50, the movable core 50 accelerates over a distance corresponding to the length of the gap 430 in the central axis CA1 direction, and then abuts the needle 40. As a result, when the fuel injection valve 1 is opening, a relatively large force in the valve-opening direction may be applied to the needle 40. Accordingly, even when the fuel pressure within the housing 20 is relatively high, the needle 40 may be moved in the valve-opening direction.

(b) Further, when the fuel injection valve 1 is opening, the movable core 50 uses the gap 430 between movable core 50 and the flange portion 43 of the needle 40 to accelerate and abut the flange portion 43. In a fuel injection valve such as the fuel injection valve 1, the speed at which the movable core 50 is moving at the moment of abutting the flange portion 43, i.e., the speed at which the needle 40 moves, is determined based on the length of this gap 430 in the central axis CA1 direction, and based on a relationship between the magnitude of the magnetic attracting force generated between the fixed core 30 and the movable core 50, the magnitude of the biasing force that biases the needle 40 in the valve-closing direction, and the magnitude of the biasing force that biases the movable core 50 in the valve-closing direction. The speed at which the needle 40 moves is correlated with fuel injection characteristics such as the amount of fuel injected during one lift operation of the needle 40, or the amount of fuel injected per time unit.

In the fuel injection valve 1, the second spring 32 biases the movable core 50 in the valve-closing direction. One end of the second spring 32 abuts the bush 60. The bush 60 is formed separately from the fixed core 30. For example, when manufacturing the fuel injection valve 1, the position of the bush 60 may be changed with respect to the movable core 50. As a result, the magnitude of the biasing force of the second spring 32 may be adjusted without changing the length of the gap 430 in the central axis CA1 direction. From this, the speed at which the movable core 50 moves may be adjusted and, therefore, the injection characteristics of the fuel injection valve 1 may be adjusted, and variations in fuel injection amounts across individual fuel injection valves may be minimized.

(c) In the fuel injection valve 1, the outer wall 433 of the flange portion 43 is slidable with the inner wall 601 of the bush 60. Accordingly, the reciprocation of the needle 40 within the housing 20 is guided by the bush 60. As a result, unintended fuel injection due to misalignment of the needle 40, such as tilting of the needle 40, may be prevented.

(d) The protrusion 434 of the flange portion 43 is inserted into the groove 602 of the bush 60. As a result, rotation of the needle 40 about the central axis CA1 may be prevented.

(e) In the fuel injection valve 1, the movable core 50 is disposed between the flange portion 43 and the restricting member 45. The distance between the flange portion 43 and the restricting portion determines the length of the gap 430 in the central axis CA1 direction. Here, the restricting member 45 is formed separately from, and fixed to, the shaft portion 41. Accordingly, the distance between the flange portion 43 and the restricting member 45 may be changed. As a result, the length of the gap 430 in the central axis CA1 direction may be easily set.

(f) When the fuel injection valve 1 is closing, the movable core 50 moves in the valve-closing direction due to a difference between the biasing force of the second spring 32 and the biasing force of the third spring 33. At that time, as the movable core 50 moves in the valve-closing direction, the biasing force of the second spring 32 gradually decreases, while the biasing force of the third spring 33 gradually increases. Accordingly, as the movable core 50 moves in the valve-closing direction, the movement of the movable core 50 in the valve-closing direction slows down. As a result, the movable core 50 abuts the restricting member 45 at a relatively slow speed, and it is possible to prevent the movable core 50 from once again moving in the valve-opening direction due to recoil from abutting the restricting member 45. Therefore, the needle 40 may be prevented from separating from the valve seat 255 as a result of the movable core 50 once again moving in the valve-opening direction, and unintended fuel injection may be prevented.

(g) The flow path 400 and the opening 411 are formed in the shaft portion 41. Here, the fuel flows in the flow path 400 from the fuel path 181 to the fuel path 182 at the movable core 50 toward the valve seat 255. As a result, a sufficient amount fuel for injection may flow within the injection nozzle 25.

Second Embodiment

Figure 4:
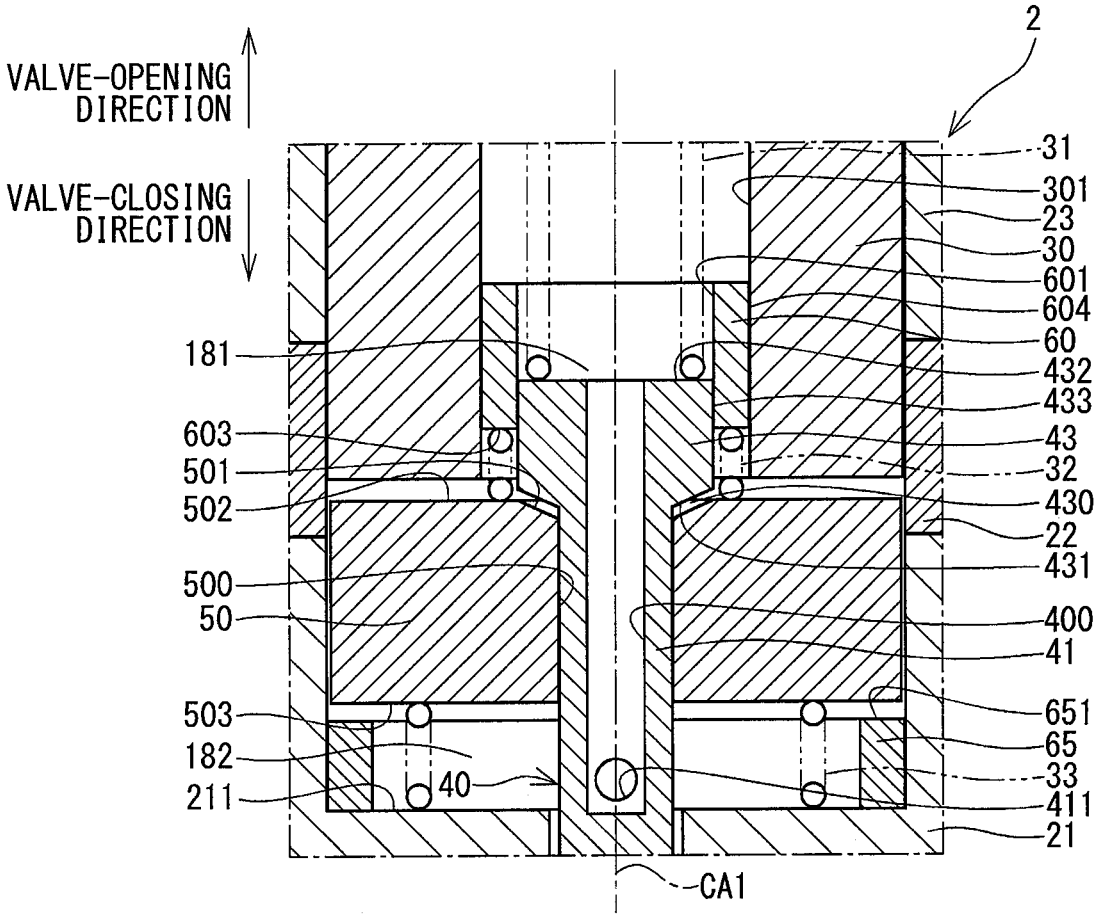
FIG. 4 is a cross-sectional view showing a fuel injection valve according to a second embodiment of the present disclosure.

Next, a fuel injection valve 2 in accordance with a second embodiment of the present disclosure will be explained with reference to FIG. 4. In the second embodiment, a restricting member is disposed at a different position than in the first embodiment. Further, elements which are substantially the same as those in the first embodiment are denoted with the same reference numerals as in the first embodiment, and explanations thereof are omitted for brevity. In addition, as shown in FIG. 4, the direction in which the needle 40 separates from the valve seat 255 is the valve-opening direction, and the direction in which the needle 40 abuts the valve seat 255 is the valve-closing direction.

In the fuel injection valve 2 in accordance with the second embodiment, instead of the restricting member 45 of the first embodiment which is disposed on a radially outward side of the shaft portion 41, a restricting member 65, which acts as a "restricting portion", is disposed at the inner wall 211 of the first cylinder member 21. The restricting member 65 restricts the movable core 50 from moving in the valve-closing direction when abutting the movable core 50.

When the fuel injection valve 2 in accordance with the second embodiment is closing, the movable core 50 moves in the valve-closing direction and separates from the flange portion 43. Thereafter, the movable core 50 abuts an end face 651 of the restricting member 65. The end face 651 faces away from the valve seat 255. Accordingly, the present embodiment differs from the first embodiment, in which during valve-closing, the movable core 50 abuts the restricting member 45 and applies a force in the central axis CA1 direction to the needle 40. Instead, in the present embodiment, during valve-closing, the movable core 50 does not apply a force in the central axis CA1 direction to the needle 40. For this reason, it is possible to prevent the needle 40 from abutting the valve seat 255, recoiling, and once again moving in the valve-opening direction. Accordingly, the second embodiment exhibits at least the effects (a) to (d) and (g) of the first embodiment, and additionally, may prevent the needle 40 from re-separating from the valve seat 255 after fuel injection is finished, and thus prevent unintended fuel injections.

Third Embodiment

Next, a fuel injection valve 3 in accordance with a third embodiment of the present disclosure will be explained with reference to FIG. 5. In the third embodiment, a bush is disposed at a different position than in the first embodiment. Further, elements which are substantially the same as those in the first embodiment are denoted with the same reference numerals as in the first embodiment, and explanations thereof are omitted for brevity. In addition, as shown in FIG. 5, the direction in which the needle 40 separates from the valve seat 255 is the valve-opening direction, and the direction in which the needle 40 abuts the valve seat 255 is the valve-closing direction.

In the fuel injection valve 3 in accordance with the third embodiment, a bush 70 is cylindrical shaped, and is housed within a groove 302 of the fixed core 30. The bush 70 is fixed to the fixed core 30 by, for example, press fitting.

Figure 5:
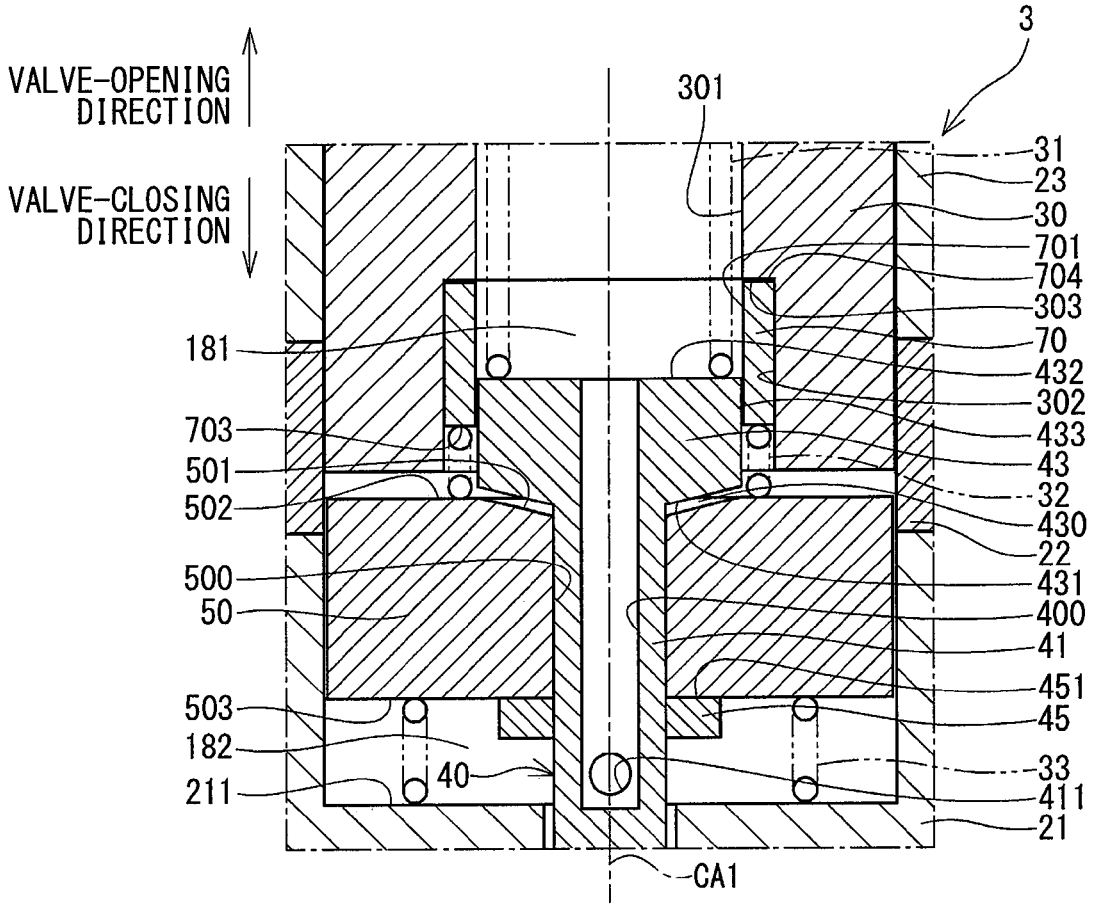
FIG. 5 is a cross-sectional view showing a fuel injection valve according to a third embodiment of the present disclosure.

Specifically, as shown in FIG. 5, the groove 302 is formed in the inner wall 301 of the fixed core 30 toward the valve seat 255. The groove 302 is formed as a recess in the inner wall 301 of the fixed core 30 that is indented radially outward. The groove 302 includes an inner wall 303 formed so as to face the movable core second abutting face 502. When the bush 70 is housed within the groove 302, an end face 704 of the bush 70 abuts the inner wall 303. Here, the end face 704 faces away from the valve seat 255.

The bush 70, which is housed within the groove 302, includes an end face 703 that faces the valve seat 255. The end face 703 abuts with one end of the second spring 32. Accordingly, the movable core 50 is biased in the valve-closing direction by the biasing force of the second spring 32. An inner wall 701 of the bush 70 is formed to be slidable with the outer wall 433 of the flange portion 43. Further, the bush 70 includes a groove (not illustrated) into which the protrusion 434 of the flange portion 43 is inserted.

In the fuel injection valve 3 in accordance with the third embodiment, the biasing force of the second spring 32 may be changed by changing the length of the bush 70, which abuts the inner wall 303, in the central axis CA1 direction. As a result, when manufacturing the fuel injection valve 3, by preparing a plurality of the bush 70 having various lengths, the second spring 32 may be set with a desired biasing force.

Further, the flange portion 43 is formed to be slidable on the bush 70, which is housed in the groove 302. Accordingly, the third embodiment exhibits at least the effects (a), (b), and (d) to (g) of the first embodiment, and additionally, since reciprocation of the needle 40 in the housing 20 is guided by the bush 70, unintended fuel injections due to misalignment of the needle 40, such as tilting of the needle 40, may be prevented.

Fourth Embodiment

Figure 6:
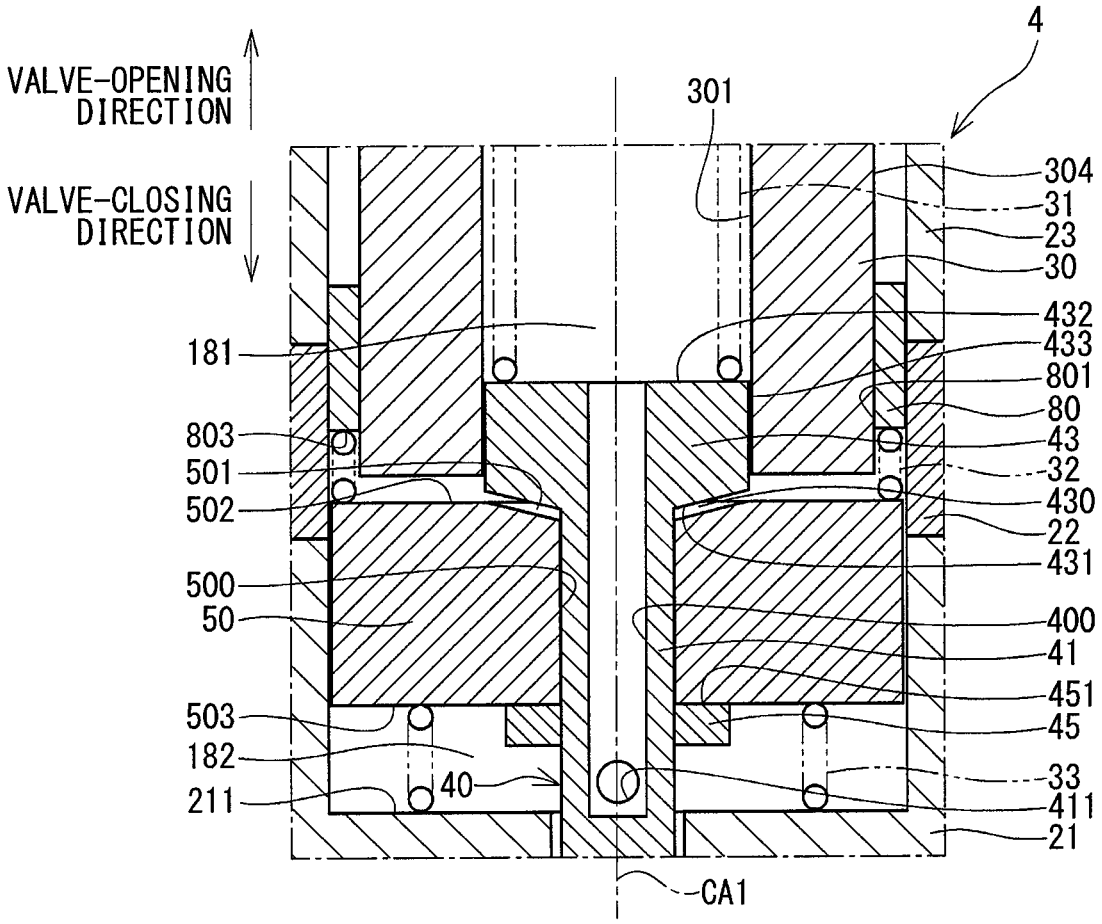
FIG. 6 is a cross-sectional view showing a fuel injection valve according to a fourth embodiment of the present disclosure.

Next, a fuel injection valve 4 in accordance with a fourth embodiment of the present disclosure will be explained with reference to FIG. 6. In the fourth embodiment, a bush is disposed at a different position than in the first embodiment. Further, elements which are substantially the same as those in the first embodiment are denoted with the same reference numerals as in the first embodiment, and explanations thereof are omitted for brevity. In addition, as shown in FIG. 6, the direction in which the needle 40 separates from the valve seat 255 is the valve-opening direction, and the direction in which the needle 40 abuts the valve seat 255 is the valve-closing direction.

In the fuel injection valve 4 in accordance with the fourth embodiment, a bush 80 is disposed between the fixed core 30 and the second cylinder member 22.

The bush 80 is substantially cylindrical shaped, and is formed separately from the fixed core 30. The bush 80 is fixed to a radially outward side of the fixed core 30. An inner wall 801 of the bush 80 abuts an outer wall 304 of the fixed core 30. An end face 803 of the bush 80 abuts one end of the second spring 32. The end face 803 faces the valve seat 255. The inner diameter of the second spring 32 is bigger than that of the first embodiment.

The outer wall 433 of the flange portion 43 is formed to be slidable on the inner wall 301 of the fixed core 30.

In the fuel injection valve 4 of the fourth embodiment, the magnitude of the biasing force of the second spring 32 may be adjusted by changing the position of the bush 80 with respect to the fixed core 30 and the movable core 50. Accordingly, the fourth embodiment exhibits at least the effects (a), (b), and (e) to (g) of the first embodiment, and additionally, since reciprocation of the needle 40 in the housing 20 is guided by the fixed core 30, unintended fuel injections due to misalignment of the needle 40, such as tilting of the needle 40, may be prevented.

Fifth Embodiment

Figure 7:
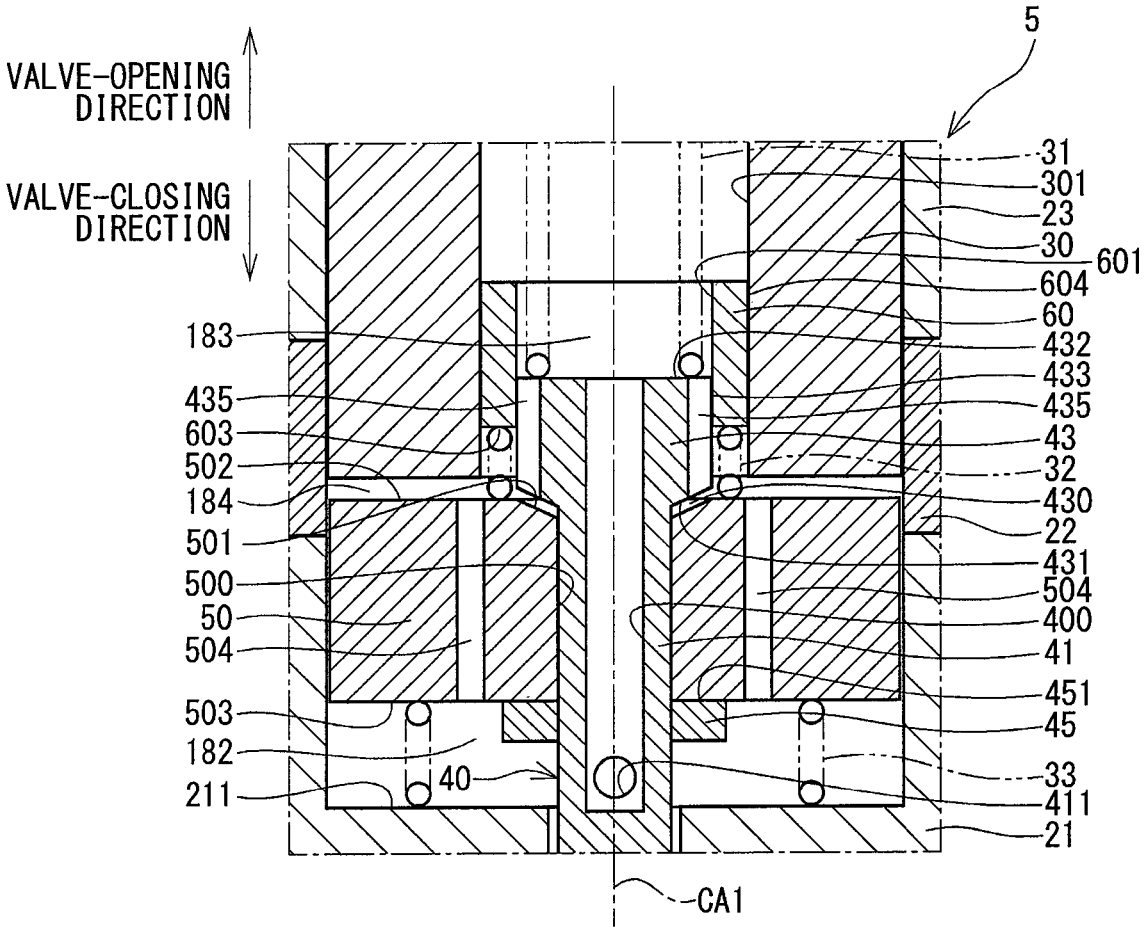
FIG. 7 is a cross-sectional view showing a fuel injection valve according to a fifth embodiment of the present disclosure.

Next, a fuel injection valve 5 in accordance with a fifth embodiment of the present disclosure will be explained with reference to FIG. 7. In the fifth embodiment, the shapes of a flange portion and a movable core are different from those of the first embodiment. Further, elements which are substantially the same as those in the first embodiment are denoted with the same reference numerals as in the first embodiment, and explanations thereof are omitted for brevity. In addition, as shown in FIG. 7, the direction in which the needle 40 separates from the valve seat 255 is the valve-opening direction, and the direction in which the needle 40 abuts the valve seat 255 is the valve-closing direction.

In the fuel injection valve 5 in accordance with the fifth embodiment, a radially outward side of the flange portion 43 includes a plurality of paths 435 that act as a "flange portion passage". The paths 435 pass through the flange portion 43 in the central axis CA1 direction. Fuel flowing in a fuel path 183 flows through the paths 435 to a fuel path 184. The fuel path 183 is at one side of the flange portion 43 away from the valve seat 255. The fuel path 184 acts as "a flow path at one side of the flange portion toward the valve seat" between the movable core 50 and the fixed core 30 or the gap 430.

The movable core 50 includes a plurality of paths 504 that are radially outward of the movable core throughhole 500. The paths 504 act as "a movable core passage". The paths 504 pass through the movable core 50 in the central axis CA1 direction. The fuel flowing in the gap 430 and the fuel path 184 flows through the paths 504 and into the fuel path 182 at the side of the movable core 50 toward the valve seat 255.

In the fuel injection valve 5 in accordance with the fifth embodiment, The fuel in the fuel path 183 flows through the paths 435, the gap 430, the fuel path 184, the paths 504, and into the fuel path 182. Accordingly, the fifth embodiment exhibits at least the same effects as the first embodiment, and additionally, the fuel flowing in from the inlet 14 may flow smoothly toward the injection holes 26.

Other Embodiments

In the first, second, third, and fifth embodiments, the inner wall of the bush slides with the outer wall of the flange portion. However, in an alternative embodiment of the present disclosure, the inner wall of the bush may not slide on the outer wall of the flange portion. If the flange portion does not slide on the inner wall of the bush or the fixed core, the outer wall of the movable core may slide on the inner wall of the housing.

In the first, second, third, and fifth embodiments, a protrusion of the flange portion is inserted into a groove of the bush. However, in an alternative embodiment of the present disclosure, the protrusion may be formed in the bush, and the groove may be formed in the flange portion. Further alternatively, the protrusion and the groove may be not formed.

In the above described embodiments, the fuel injection valve includes a third biasing member. However, in an alternative embodiment of the present disclosure, the third biasing member may be not provided.

In the second, third, and fourth embodiments, the needle includes a flow path and an opening that act as "a needle passage". However, in an alternative embodiment of the present disclosure, in addition to this "needle passage", similar to the fifth embodiment, a "flange portion passage" and a "movable core passage" may be formed in the flange portion and movable core, respectively. By forming the "movable core passage" in the movable core, fuel may flow in and out of the "movable core passage" between a side of the movable core toward the valve seat and the other side of the movable core toward the fixed core. As a result, the movable core may smoothly reciprocate inside the housing.

In the fifth embodiment, the fuel injection valve includes "a needle passage", "a flange portion passage", and "a movable core passage". However, in an alternative embodiment of the present disclosure, only the "flange portion passage" and the "movable core passage" may be formed, without the "needle passage" being formed.

In the fifth embodiment, the flange portion includes paths that act as "a flange portion passage" and which are formed at a radially outward side of the flange portion. However, in an alternative embodiment of the present disclosure, the location of the "flange portion passage" is not limited as such. It is acceptable as long as the "flange portion passage" passes through one side of the flange portion away from the valve seat to the other side of the flange portion toward the valve seat.

In the above described embodiments, the first biasing member abuts an end face of the flange member that faces away from the valve seat. However, in an alternative embodiment of the present disclosure, the first biasing member may abut an end face of the shaft portion that faces away from the valve seat.

In the above described embodiments, the flange end face is formed as a tapered surface. However, in an alternative embodiment of the present disclosure, the flange end face may formed as a level surface.

In the above described embodiments, the movable core first abutting face is formed as a tapered surface. However, in an alternative embodiment of the present disclosure, the movable core first abutting face may formed as a level surface. In other words, the movable core first abutting face may be formed to be coplanar with the movable core second abutting face.

In the above described embodiments, the flange portion and the shaft portion are integrally formed. However, in an alternative embodiment of the present disclosure, the flange portion and the shaft portion may be separately formed.

In the above described embodiments, the restricting portion and the shaft portion are separately formed. However, in an alternative embodiment of the present disclosure, if the flange portion and the shaft portion are separately formed, then the restriction portion and the shaft portion may be integrally formed.

In the above described embodiments, the flange portion and the restricting portion are substantially cylindrical shaped. However, in an alternative embodiment of the present disclosure, the flange portion and the restricting portion are not restricted to such a shape, and may be elliptical or polygonal instead. Alternatively, the flange portion and the restriction portion may be formed as protrusions that protrude from a part of the circumference of the shaft portion.

The present disclosure is not limited to the embodiments described above, and a variety of embodiments are contemplated without departing from the gist of the present disclosure.

The invention claimed is:

1. A fuel injection valve, comprising:

a housing that includes an injection hole formed at one end of the housing in a central axis direction and a valve seat formed surrounding the injection hole;

a needle member reciprocably disposed within the housing, the injection hole being open when one end of the needle separates from the valve seat and closed when the one end of the needle abuts the valve seat;

a flange portion disposed on a radially outward side of an other end of the needle member so as to be integrally reciprocable with the needle member;

a movable core disposed on one side of the flange portion toward the valve seat, the movable core being movable relative to the needle member;

a restricting portion disposed on one side of the movable core toward the valve seat, the restricting portion being configured to restrict movement of the movable core in a valve-closing direction when the movable core abuts the restricting portion;

a fixed core disposed on an other side of the movable core away from the valve seat, the fixed core being fixed to the housing;

a bush disposed at a fixed position on an inner wall or an outer wall of the fixed core, the bush being formed separately from the fixed core;

a coil configured to, when supplied with electric power, generate a magnetic field that attracts the movable core to the fixed core;

a first biasing member having one end that abuts the flange portion or the needle member, the first biasing member being configured to bias the needle member in the valve-closing direction; and a second biasing member having one end that abuts an end face of the bush facing the valve seat and having an other end that abuts the movable core, the second biasing member being configured to bias the movable core in the valve-closing direction, wherein when the movable core abuts the restricting portion, a gap is formed between the flange portion and the movable core.

2. The fuel injection valve of claim 1, wherein the bush includes an inner wall that slides with an outer wall of the flange portion.

3. The fuel injection valve of claim 2, wherein one of the outer wall of the flange portion and the inner wall of the bush includes a protrusion that protrudes in a radial direction, and an other one of the outer wall of the flange portion and the inner wall of the bush includes a groove in which the protrusion is inserted, the groove being formed to extend along a reciprocating direction of the needle member.

4. The fuel injection valve of claim 1, wherein the restricting portion is formed separately from the needle member and is fixed on the needle member.

5. The fuel injection valve of claim 1, wherein the restricting portion is disposed at an inner wall of the housing to be fixed to the housing.

6. The fuel injection valve of claim 1, further comprising:

a third biasing member that biases the movable core in a valve-opening direction with a smaller biasing force than that of the second biasing member.

7. The fuel injection valve of claim 1, wherein the needle member includes a needle passage that connects a fuel path at the one side of the movable core toward the valve seat with a fuel path at the other side of the movable core away from the valve seat.

8. The fuel injection valve of claim 1, wherein the flange portion includes a flange portion passage that connects a fuel path at the one side of the flange portion toward the valve seat with a fuel path at an other side of the flange portion away from the valve seat.

9. The fuel injection valve of claim 1, wherein the movable core includes a movable core passage that connects a fuel path at the one side of the flange portion toward the valve seat with a fuel path at the one side of the movable core toward the valve seat.

* * * * *